US006830228B2

(12) United States Patent
Ernst

(10) Patent No.: US 6,830,228 B2
(45) Date of Patent: Dec. 14, 2004

(54) HANGER ASSEMBLY

(75) Inventor: Richard J. Ernst, San Diego, CA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/103,368

(22) Filed: Mar. 21, 2002

(65) Prior Publication Data

US 2003/0178545 A1 Sep. 25, 2003

(51) Int. Cl.[7] ..... A47F 7/14; A47G 1/16

(52) U.S. Cl. ..... 248/475.1; 248/216.1; 248/489; 248/497

(58) Field of Search ..... 248/216.1, 217.1, 248/217.3, 216.4, 475.1, 489, 493, 497, 496, 477, 684, 576, 301, 305, 218.3; D8/367, 373; 40/757, 617

(56) References Cited

U.S. PATENT DOCUMENTS

| | | | | | |
|---|---|---|---|---|---|
| 165,206 | A | * | 7/1875 | Brown | |
| 1,999,575 | A | * | 4/1935 | Reuter | |
| 2,282,631 | A | * | 5/1942 | Winship | 411/516 |
| 3,143,915 | A | * | 8/1964 | Tendler | 411/29 |
| 3,298,651 | A | * | 1/1967 | Passer | |
| 3,861,631 | A | * | 1/1975 | Shorin | 248/218 |
| 3,912,211 | A | * | 10/1975 | Topf | 248/217 |
| 3,926,394 | A | * | 12/1975 | Mauceri et al. | 248/217 |
| 3,966,157 | A | * | 6/1976 | Corral | 248/217 |
| 4,613,108 | A | | 9/1986 | Sundestrom et al. | 248/497 |
| 4,619,430 | A | | 10/1986 | Hogg | 248/467 |
| 4,821,992 | A | * | 4/1989 | Johnson | 248/493 |
| D301,975 | S | | 7/1989 | Mullen | D8/371 |
| 4,871,140 | A | | 10/1989 | Hoskinson et al. | 248/496 |
| 5,028,030 | A | | 7/1991 | Lewis | 248/493 |
| 5,149,037 | A | | 9/1992 | Smith | 248/216.1 |
| D339,980 | S | | 10/1993 | Sheehan | D8/373 |
| 5,267,718 | A | | 12/1993 | Sheehan | 248/475.1 |
| 5,267,719 | A | | 12/1993 | Keller | 248/493 |
| 5,437,429 | A | | 8/1995 | Atlas | 248/493 |
| 5,584,462 | A | | 12/1996 | Reese | 248/477 |
| 5,596,792 | A | * | 1/1997 | Shelton | 24/336 |
| 5,878,988 | A | * | 3/1999 | Rakower | 248/497 |
| 6,126,126 | A | * | 10/2000 | McKiernan, Jr. | 248/217.3 |
| 6,279,862 | B1 | | 8/2001 | Gershowitz | 248/216.1 |

FOREIGN PATENT DOCUMENTS

| | | |
|---|---|---|
| CH | 491 296 | 5/1970 |
| WO | WO 96/02170 | 1/1996 |

* cited by examiner

*Primary Examiner*—Gwendolyn Baxter
(74) *Attorney, Agent, or Firm*—Mark W. Croll, Esq.; Lisa M. Soltis, Esq.; Welsh & Katz, Ltd.

(57) ABSTRACT

A hanger for mounting an associated object to a wall includes a body portion having a first surface for bearing against the wall. The body portion defines first and second end portions. An upper anchoring portion is formed at the first end for penetrating the wall and for fastening the hanger to the wall. The upper anchoring portion extends rearwardly from the body portion and is formed at an angle equal to or less than 90 degrees relative to the body. The anchoring portion has a piercing portion to enable the anchoring portion to be driven into the wall. At least one barb extends rearwardly from the body portion. The barb is formed intermediate the first end portion and the second end portion and is formed at an angle relative to the body equal to or greater than 90 degrees. A hook portion extends generally forwardly from the body portion at the second end. The hook is positioned longitudinally spaced from the at least one barb. The hanger can be formed as a two part member.

15 Claims, 5 Drawing Sheets

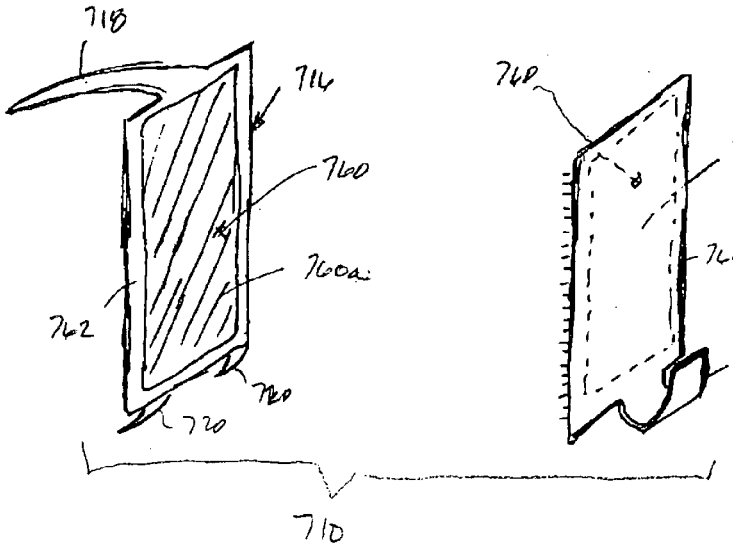
FIG. 18
FIG. 19
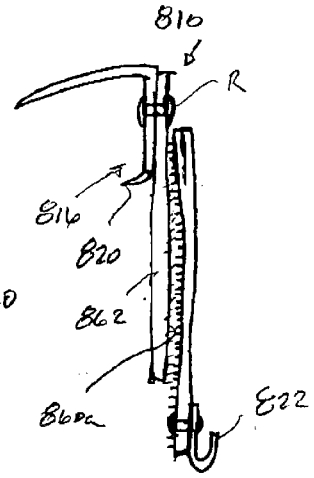
FIG. 20
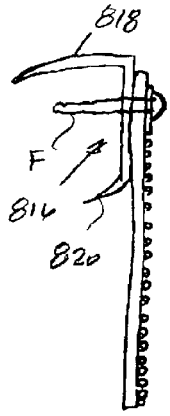
FIG. 21
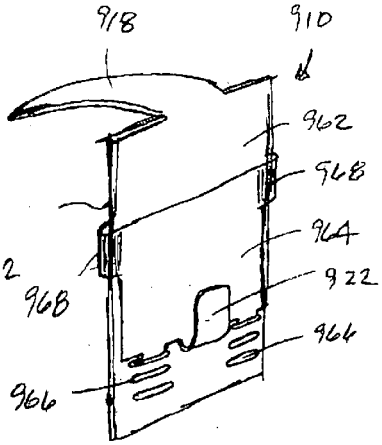
FIG. 22
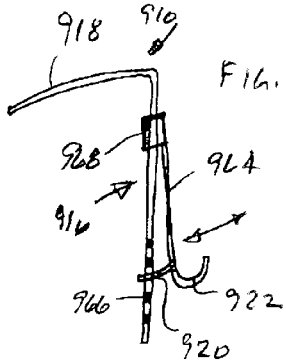
FIG. 23

HANGER ASSEMBLY

BACKGROUND OF THE INVENTION

The present invention pertains to a hanger assembly. More particularly, the present invention pertains to a readily installed hanger assembly having a supporting barb, for securely mounting an object, such as a picture frame, to a wall.

Hanger assemblies used for mounting objects, such as pictures, to a wall are generally known. Some hanger assemblies are fastened to the wall using fastening members, such as screws or the like. One drawback of such assemblies is that during installation, these fasteners typically create holes in the wall, which can be unsightly as well as costly to repair. Other drawbacks of such hangers are that can be relatively difficult to install and may have limited load-bearing capabilities. For example, in order to achieve a strong, secure connection with the wall, these assemblies typically require that a hole be drilled in the wall for receiving an anchor, or that a stud be located in the wall to receive the fastening member.

Such other hangers may not provide a sufficiently secure connection with the wall to prevent the hanger from being pulled out of the wall when subjected to a load. For example, U.S. Pat. No. 5,267,719 to Keller discloses a picture frame hanger that has a bottom peg that engages the wall at 90 degrees to prevent the hanger from pivoting. However, this configuration does not provide a load bearing connection at the wall and as such may not prevent the hanger assembly from being pulled from the wall when placed under static or dynamic load conditions.

Accordingly, there exists a need for an integral hanger assembly having an anchoring portion that enables an object, such as a picture frame, to be securely mounted to a wall. Desirably the hanger assembly has an anchor portion that enables the hanger assembly to be easily installed with minimal damage to the wall. More desirably, such a hanger assembly includes one or more supporting tabs that enable the hanger assembly to be used to securely mount heavy objects to the wall in dynamic as well as static load conditions.

BRIEF SUMMARY OF THE INVENTION

A hanger for mounting an associated object to a wall includes a body portion having a first surface for bearing against the wall. The body portion defines first and second end portions. An upper anchoring portion is formed at the first end for penetrating the wall and for fastening the hanger to the wall. The upper anchoring portion extends rearwardly from the body and is formed at an angle relative to the body of 90 degrees or less. The anchoring portion has a piercing portion to enable the anchoring portion to be driven into the wall.

The hanger includes at least one barb extending rearwardly from the body portion. In a preferred embodiment, the hanger includes two barbs extend from the body. The barbs are formed intermediate or between the first end and the second end. The barbs are formed at an angle relative to the body of 90 degrees or greater. The barbs can be formed at about the same angle relative to the body or at different angles from one another.

A hook portion extends generally forwardly from the body portion at the second end. The hook is positioned longitudinally spaced from the at least one barb. The hook can be configured having a retaining region, such as is formed by a restriction between the hook and the body portion. The body can include an opening to, for example, receive a fastener.

The barbs can be positioned longitudinally intermediate the hook and the anchoring portion. The barbs can be positioned in a longitudinal orientation and can be aligned with one another or staggered relative to one another.

The hanger can include a retention tab extending forwardly from the body intermediate a base of the hook and the anchoring portion.

The hanger can be formed as a two part member in which the hook portion is separable from and adjustable along the body portion. This permits adjusting the height of the hung object without adjusting the height of the body of the hanger. In one embodiment, the hook portion and body portion each include one part of mating parts of a hook and loop fastener system. The body portion of the hook and loop fastener system can be secured to a base element formed as part of the hanger body. Alternately, the base element can be a separate part from the hanger body and affixed thereto. The base element can be secured to the hanger body by a rivet or by a self-limiting fastener that secures the entirety of the hanger to the wall.

Alternately still, the two part hanger can be configured such that the base portion includes openings therein. The barbs can be formed on the hook portion. The barbs are received in the openings to secure the hanger to the wall. In such an embodiment, guide elements can be positioned on the hook portion for slidingly mounting the hook portion to the body portion.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
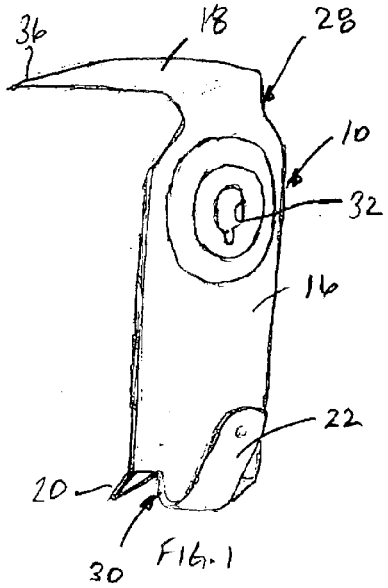
FIG. 1 is a perspective view of a hanger assembly, in accordance with one embodiment of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Figure 2:
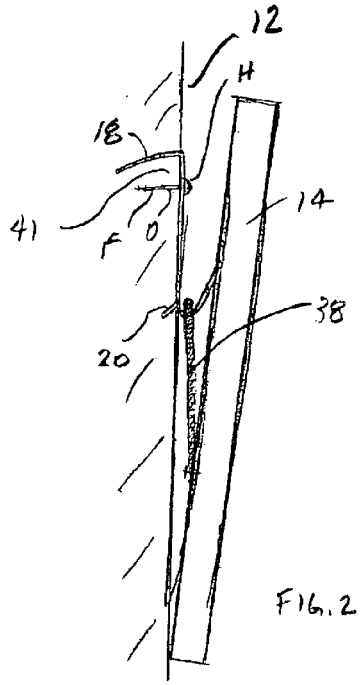
FIG. 2 illustrates the hanger assembly of FIG. 1, in a fastened position, with a mounted object.

Referring now the drawings, and more particularly FIGS. 1–5, there is shown one embodiment of a hanger assembly 10, in accordance with the principles of the present invention. The hanger assembly 10 is used for mounting an associated object 14, such as a picture, plaque, or the like, to a wall 12 or similar structure, as illustrated in FIG. 2. The hanger assembly 10 includes a body portion 16, an upper anchoring portion or tang 18, one or more supporting barbs 20, and a hook portion 22.

The body portion 16 has a first or rear surface 24 and a second or front surface 26. The body 16 defines a first or upper end portion 28 and a second or lower end portion 30. Preferably, the rear surface 24 is generally planar to enable the hanger assembly 10, to be positioned adjacent or abutting the wall 12, when in a mounted position. The body 16 can be formed having an opening 32 therein for receiving a fastening member F, such as a screw, nail or the like, if desired. Preferably, the opening 32 is configured for receiving a self-metering fastener.

Figure 17:
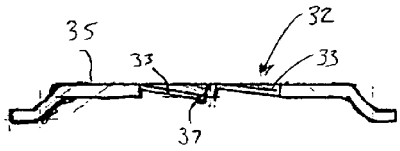
FIG. 17 is a cross-sectional view taken along line 17—17 of FIG. 4, illustrating the helical thread formation in the hanger opening configured for receiving a self-metering or self-limiting fastener.

A cross-sectional view of the hanger 10, illustrating a portion of the opening 32 is shown in FIG. 17. As seen, the opening 32 includes a portion of a thread formation, as indicated at 33. That is, the inner periphery of the opening includes a portion of a helical thread 33 configured for receiving the fastener F. An area 35 adjacent the opening 32 can be raised to accommodate the rear most portion of the helical thread 37. The thread 33 can include an opening, such as the exemplary slot 39, that permits starting threaded engagement of the fastener F with the opening thread 33.

The use of such a self-metering or self-limiting fastener will be appreciated by those skilled in the art. In use, the fastener F progresses by engagement of the fastener threads (not shown) along the opening thread 33 (as the fastener F is turned or rotated), rather than by engagement with an opening in the wall 12. As will be recognized by those skilled in the art, often, attempting to thread and tighten a screw or other threaded fastener into drywall, gypsum board or the like, merely creates a hole in the wall that is too friable to support and secure the fastener. Rather than "holding" the fastener, wall board material will break away or crumble and the fastener will continue to rotate without biting into (securing to) the wall.

The threaded opening 32 in the hanger 10, on the other hand, provides a rigid (metal) path for engaging the fastener F threads. Thus, the fastener F is provided with a thread path along which to progress. In addition, the threaded hanger opening 32 also "limits" the travel or depth to which the fastener F can be driven into the wall 12 because the fastener F will stop progressing (rotating or threading) once the fastener head H contacts the hanger 10. Advantageously, this also facilitates maintaining the integrity of the wallboard material immediately surrounding the wall opening O, by preventing strip-out.

In a preferred arrangement, the opening 32 is positioned in the body 16 near the anchoring portion 18 to enhance engagement of the hanger 10 with the wall 12. This also maintains the wallboard material compacted in the area, indicated at 41, between the fastener F and the anchoring portion 18.

Figure 3:
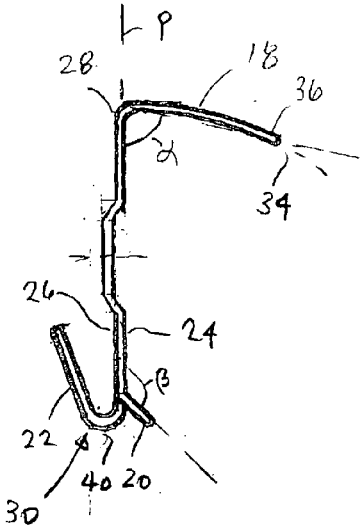
FIG. 3 is a side view of the hanger assembly of FIG. 1.
Figure 4:
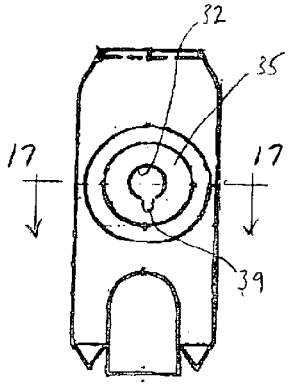
FIG. 4 is a front view of the hanger assembly of FIG. 1.
Figure 5:
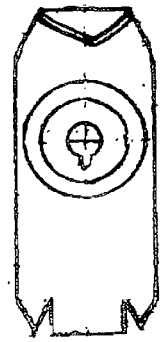
FIG. 5 is a rear view of the hanger assembly of FIG. 1.

The anchoring portion 18 is formed at the hanger first end 28. The upper anchoring portion 18 extends rearwardly from the body 16 and is formed at an angle $\alpha$ that is about or less than 90 degrees relative to a plane P defined by the body 16, as seen in FIG. 3.

Preferably, the anchoring portion 18 has a generally downwardly curved or arcuate shape as indicated at 34. Alternately, although not shown, the anchoring portion or tang can be straight and angled downwardly in the same manner as the exemplary, illustrated curved portion 18. The anchoring portion 18 includes a piercing portion 36 to facilitate piercing the wall 12 and to enable the anchoring portion 18 to be readily driven into the wall 12. Preferably, the piercing portion 36 is configured as a relatively sharp tip to permit easily installing the anchoring portion 18 in the wall 12.

One or more supporting barbs 20 are formed at the second end 30. Each supporting barb 20 is likewise inserted (e.g., driven) into the wall 12 to further secure the hanger assembly 10 to the wall. Each barb 20 extends rearwardly from the body 12 and is formed at an angle $\beta$ that is about or greater than 90 degrees relative to the body plane P, as seen in FIG. 3. Preferably the supporting barb 20 has a generally sharp tip, which enables the barb 20 to "bite" or pierce the face of wall 12 as the hanger assembly 10 is forced or pressed into a mounting position. It has been found that, upon loading, the barbs 20 tend to self-set in the wall 12. In a current embodiment, the hanger assembly includes two supporting barbs 20 to enhance the "hold" or to facilitate securing the assembly to the wall 12. The barbs 20 also prevent the hanger 10 (and thus the hung object 14) from sliding down the wall 12, by reducing the tendency of the anchoring portion 18 to cam away from the wall 12.

The hook portion 22 is integrally formed at the second end 30, extending generally forwardly from the body 16. The hook 22 has a generally upwardly curved-shape for receiving an object connection member 38, such as the illustrated wire shown in FIG. 2. Preferably, the hook 22 is formed opposite the supporting barb 20, with the base 40 of the hook 22 below the barb 20. That is, the supporting barbs 20 extend rearwardly from the body 16 intermediate or between the hook base 40 and the anchoring portion 18. In this manner, the load that is exerted on the hanger assembly 10 is outside of the "envelope" defined by the anchoring portion 18 and the barbs 20.

In essence, the angles $\alpha$ and $\beta$ at which each the anchoring portion 18 and the barbs 20 are formed, relative to the body 16, are downward relative to the wall 12 and act with the gravitational force exerted on the hanger assembly 10 when it is loaded, such as when it is supporting a picture or like hanging object 14. It has been found that these angles $\alpha$ and $\beta$ tend to direct the hanger 10 into the wall 12 as the load increases. Moreover, it has also been found that these angles, in combination with locating the hook 22 below the barbs 20 (e.g., locating the barbs 20 between the hook 22 and the anchoring portion 18), further enhance the "hold" of the hanger 10 to the wall 12.

Figure 6:
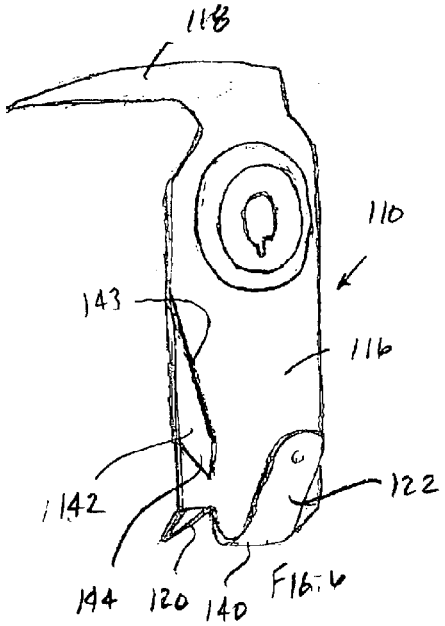
FIG. 6 is a perspective view of another embodiment of the hanger assembly, the hanger assembly configured with a retention tab.
Figure 7:
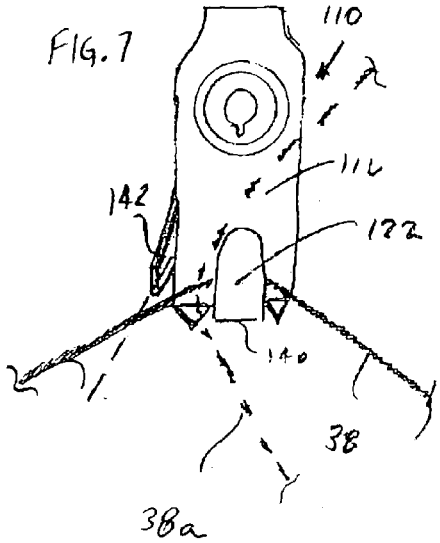
FIG. 7 is a front view of the hanger assembly of FIG. 6 illustrated with a wire positioned on the hanger.
Figure 8:
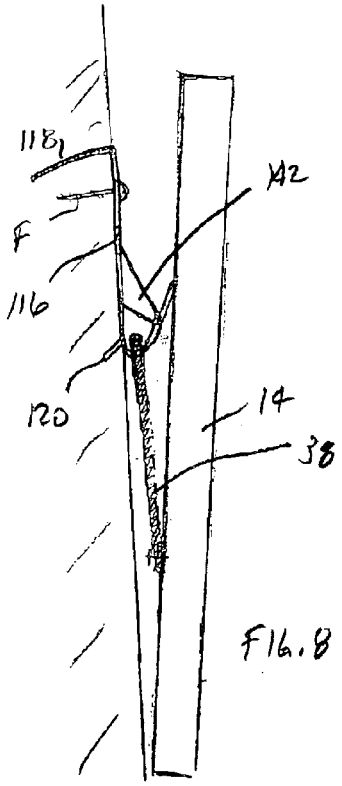
FIG. 8 is a side view of the hanger assembly of FIG. 6, in a fastened position, with a mounted object.

Referring now to FIGS. 6–8, there is shown an alternate embodiment of the hanger assembly 110 having a retention member 142 for effectively securing the object 14 (e.g., the wire 38) to the hanger 110. The hanger 110 is similar to that shown in FIGS. 1–5, and includes the retention member 142 that extends generally forwardly from an edge of the body 116. The retention member 142 includes a downwardly sloped upper surface 143 that directs the wire 38 into the hook 122. The retention member 142 can include a projection or finger 144 that is downwardly oriented, i.e., oriented toward the hook 122, extending from the body 116 between a base 140 of the hook 122 and the anchoring portion 118.

The retention member 142 is configured to secure, for example, the wire 38, to the hanger 110. Such a configuration may be desirable when, for example, the object 14 may be bumped or jostled or where seismic activity (e.g., earthquakes) may be a concern that could other dislodge the object 14 from the hanger 110. The retention member 142 can be angled outwardly from the body 116, as seen in FIG. 7, to facilitate purposeful removal of the wire 38 from the hanger 110 by rotating the object 14 (when removing the wire 38 from the hook 122), so that the wire 38 passes between the retention member 142 and hook 122 (see e.g., wire 38*a* shown in phantom lines in FIG. 7).

Because of the downwardly sloped upper surface 143, the wire 38 slides essentially imperceptibly over the retention member 142, but is retained on the hook 122 by the finger 144. In this manner, installation of the object 14 is carried out as would be with any other type of picture hook (that is guiding the wire downward onto the hook) and removal is readily effected by rotating the object 14 (and the wire 38) to pass between the retention member 142 and the hook 122.

Those skilled in the art will recognize the various configurations that such a retention member 142 may take, and the configurations that the member 142 may take relative to the hanger 110 overall, which configurations are within the scope and spirit of the present invention.

Figure 9:
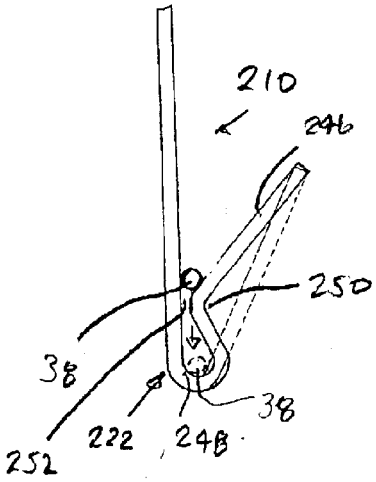
FIG. 9 is a side view of another embodiment of the hanger assembly having a bent hook portion.

FIG. 9 illustrates a portion of still another embodiment of the hanger assembly 210 that is also configured to retain the wire 38 secured within the hook 222. The illustrated hook 222 has a "cotter pin" shape including an upper ramped portion 246 and a lower wire retaining region 248. A converging or neck region 250 is formed intermediate the ramped portion 246 and the retaining region 248 that defines a restriction thus forming the "cotter pin" shape. To securely mount the object 14 to the hanger assembly 210, the wire 38 is inserted or pulled through the neck 250. The wire 38 is maintained securely in the retaining region 248 by interference at the neck 250 and because of the small gap 252 between the hook 222 and the body 216 at the neck 250.

Figure 10:
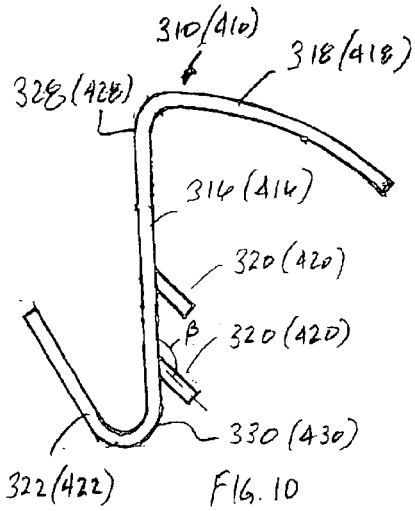
FIG. 10 is a side view of still another embodiment of the hanger, the hanger shown with longitudinally oriented supporting barbs.
Figure 11:
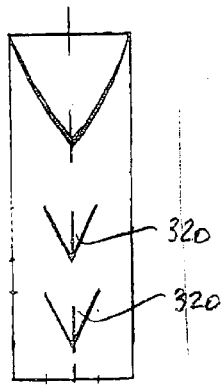
FIG. 11 is a rear view of the hanger assembly of FIG. 10 having supporting barbs in longitudinal aligned longitudinally oriented supporting barbs.
Figure 12:
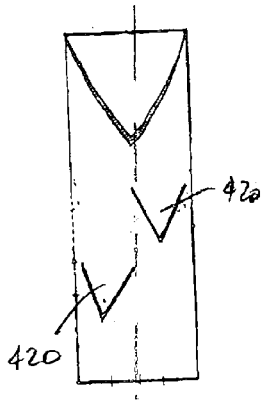
FIG. 12 is a rear view of a hanger assembly similar to that of FIG. 11 having laterally staggered longitudinally oriented supporting barbs.

Referring now to FIGS. 10–14, there are shown yet other embodiments of the hanger assembly 310, 410, 510. FIG. 10 is representative of a side view of the embodiments 310, 410. Both of these embodiments 310, 410 include a plurality of longitudinal oriented support barbs 320, 420 positioned generally intermediate their respective anchoring portions 318, 418 and hooks 322, 422, along the bodies 316, 416, between the first end portions 328, 428 and the second end portions 330, 430. The support barbs 320, 420 extend rearwardly from the body portions 316, 416 at an angle $\beta$ that is 90 degrees or greater relative to their respective body portion 316, 416. As shown in FIG. 11, the support barbs 320 can be longitudinally aligned with one another. Alternately, as seen in FIG. 12, the barbs 420 can be longitudinally oriented but laterally (e.g., side-to-side) staggered relative to one another. These hanger embodiments 310, 410 can be formed having an opening (not shown) in the body of having an opening similar to that of the embodiment 10 of FIGS. 1–5.

Figure 13:
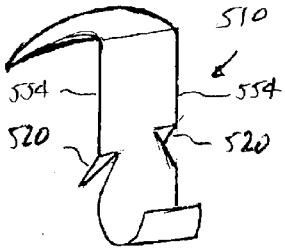
FIG. 13 is a perspective view of still another embodiment of the hanger having the supporting barbs formed at a side edge of the hanger.
Figure 14:
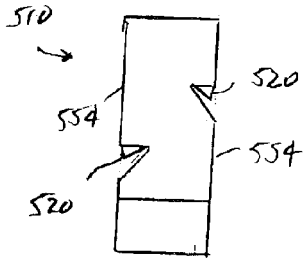
FIG. 14 is a front view of the hanger of FIG. 13.

The embodiment of FIGS. 13 and 14 includes a barb 520 formed in a side edge 554 of the hanger 510. As illustrated the hanger can include two barbs 520 formed in opposing side edges 554 of the hanger. The barbs 520 can be formed side-by-side or, as shown, in a staggered arrangement.

Figure 15:
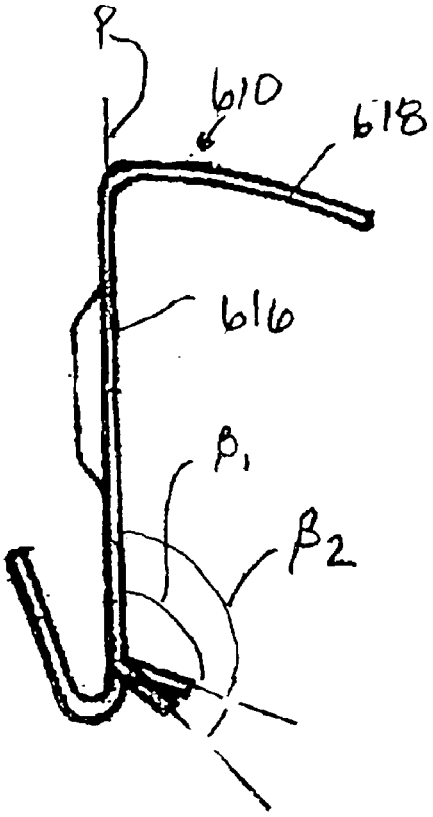
FIG. 15 is a side view of yet another embodiment of the hanger assembly, the hanger assembly being similar to that of FIGS. 1–5, but having supporting barbs extending from the body at different angles.
Figure 16:
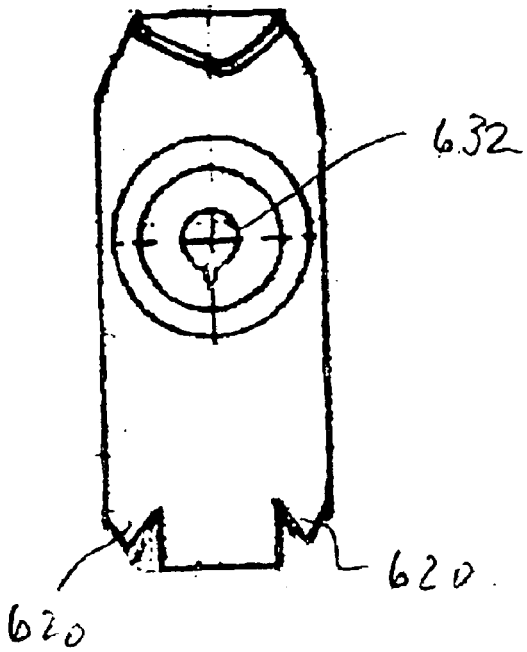
FIG. 16 is a rear view of the hanger assembly of FIG. 15.
Figure 1:
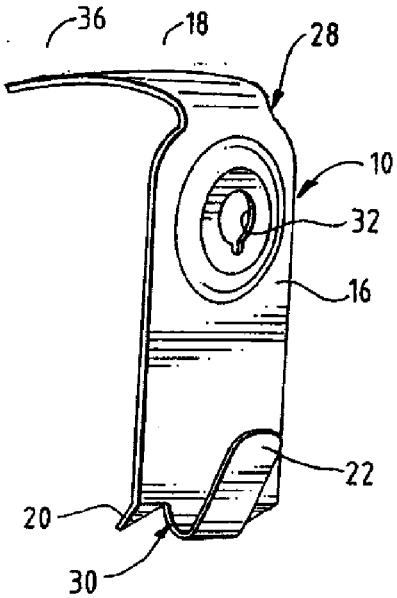
Figure 2:
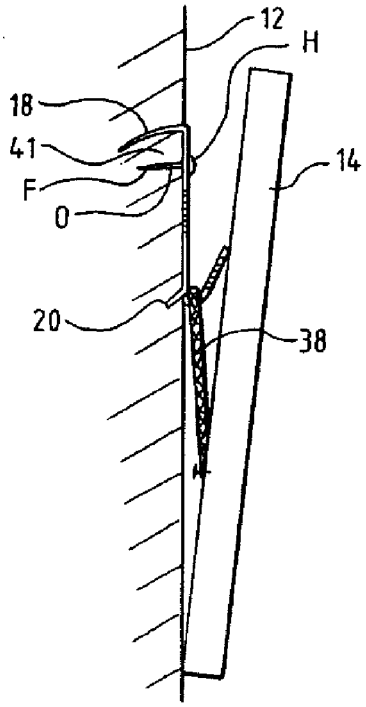
Figure 3:
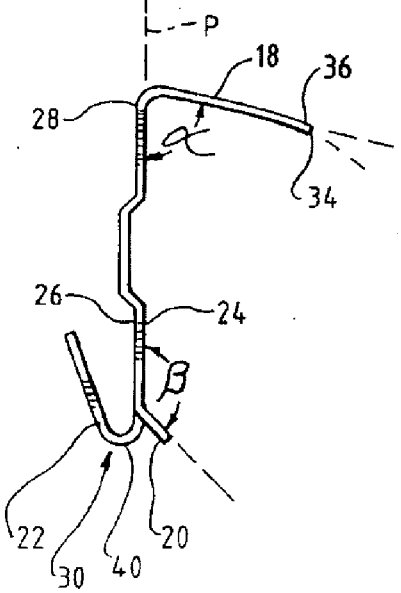
Figure 4:
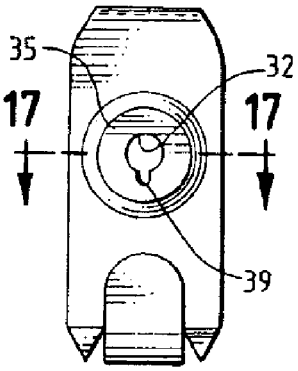
Figure 5:
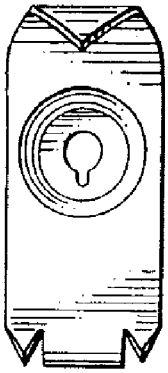
Figure 6:
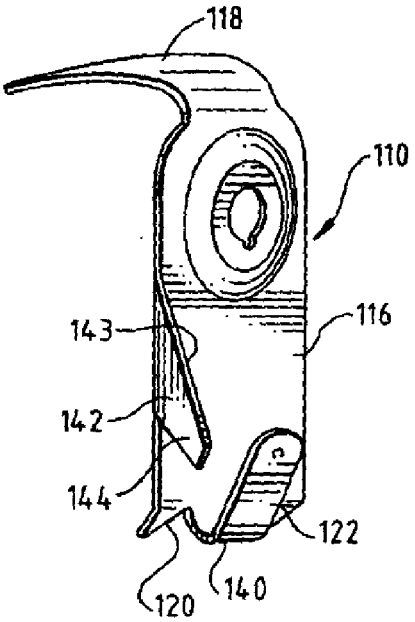
Figure 7:
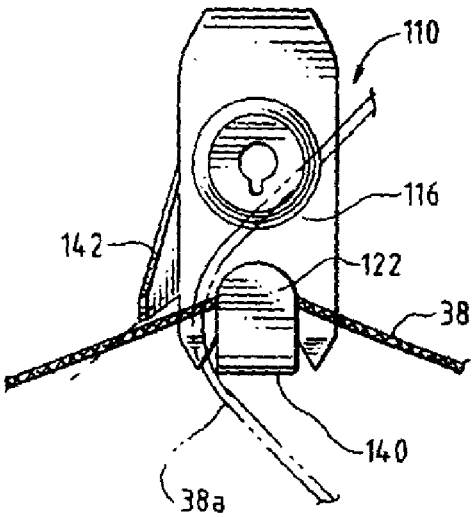
Figure 8:
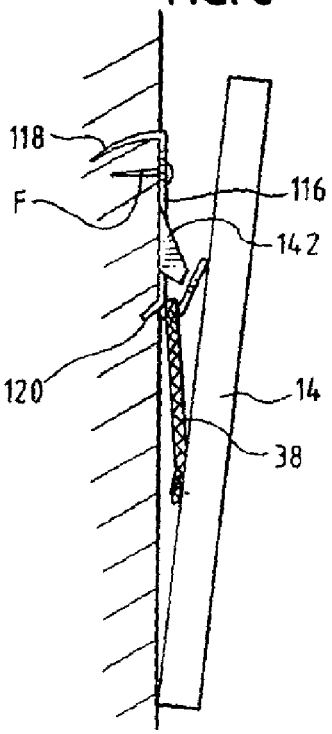
Figure 9:
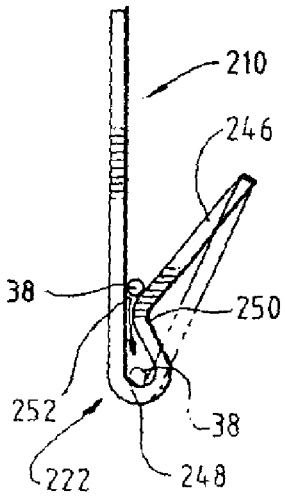
Figure 10:
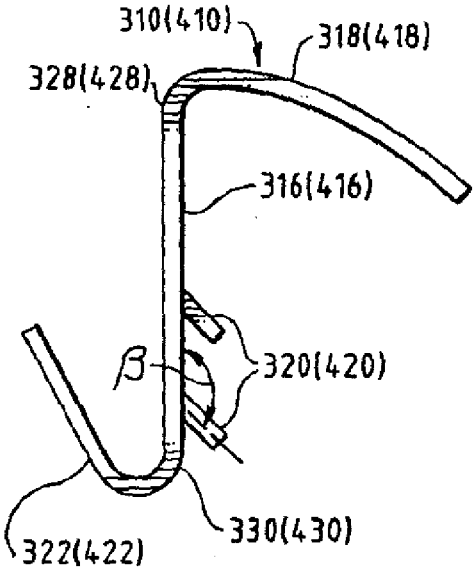
Figure 11:
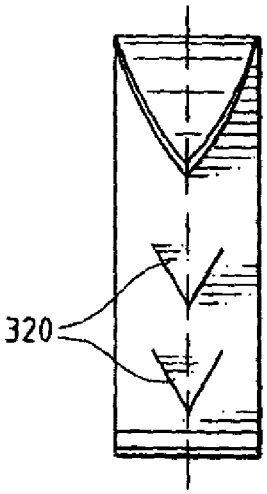
Figure 12:
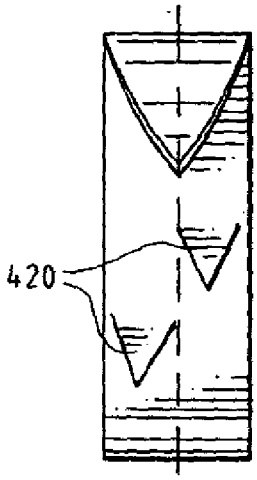
Figure 13:
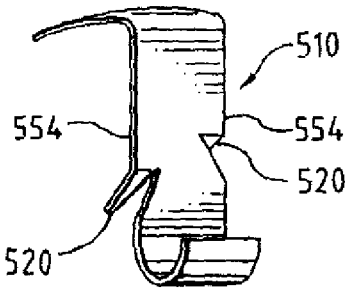
Figure 14:
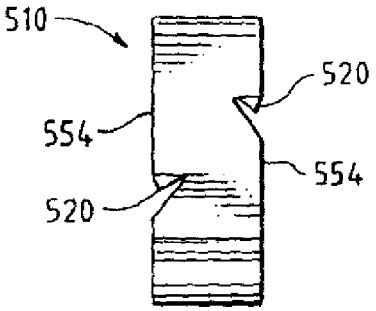
Figure 15:
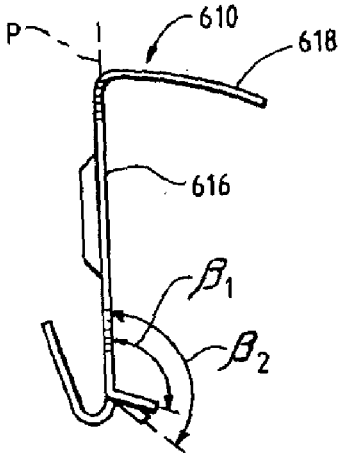
Figure 16:
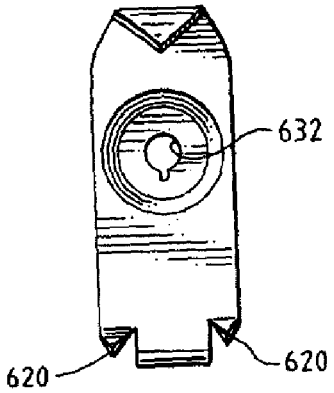
Figure 17:
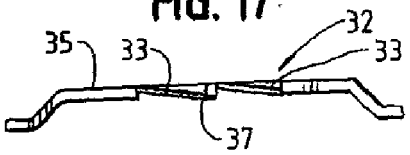

Referring now to FIGS. 15 and 16, there is shown still another embodiment of the hanger assembly 610. The hanger assembly 610 is formed similar to that of the embodiment 10 illustrated in FIGS. 1–5, including two supporting barbs 620. The barbs are formed at angles $\beta_1$, $\beta_2$ that are different from one another, at least one of the angles, $\beta_1$ and $\beta_2$ being equal to or greater than 90 degrees relative to the body 616. The varied angles $\beta_1$ and $\beta_2$ establish a different "bite" or connection with the wall, preventing the hanger assembly 610 from sliding or pulling from the wall 12 or from rotating about the anchor 618. The hanger 610 can be formed having an opening 632 for receiving a fastener or the like.

FIGS. 18–23 illustrate various two part hangers 710–910 embodying the principles of the present invention. The two part hangers 710–910 are configured to permit adjusting the height of the respective hooks 722–922 relative to the position on the wall at which the body 716–916, e.g., the anchoring portion 718–918 is positioned. In this manner, the height of an object 14, such as a picture can be adjusted or varied, within a certain amount, regardless of height at which the body portion 716–916 is positioned.

Figure 18:
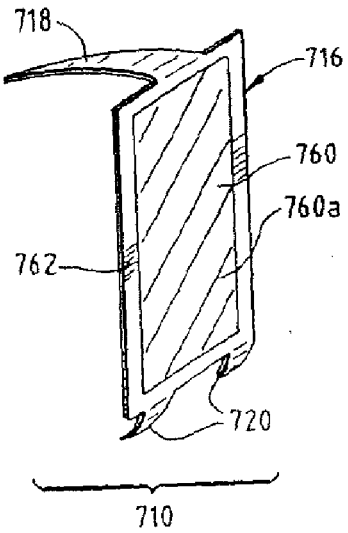
FIG. 18 is a perspective view of a portion of still another embodiment of the hanger, this embodiment being a base portion of a two part, adjustable hanger.
Figure 19:
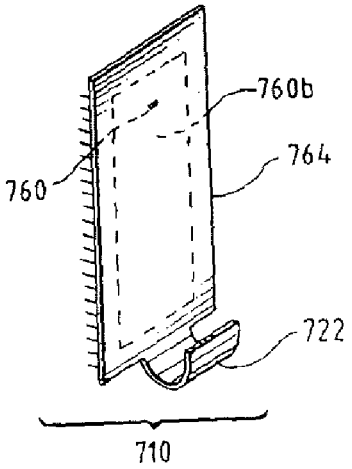
FIG. 19 illustrates a hanger portion for use with the base of FIG. 18.

FIGS. 18–19 illustrate an embodiment 710 that uses a mechanical hook and loop fastener system 760. A base portion 762 of the hanger 710 includes the body 716, the anchoring portion 718 and at least one and preferably two barbs 720. One portion 760*a* of the mating hook and loop fastener system 760 is affixed to the body 716, and a mating portion 760*b* of the fastener system is affixed to a hook portion 764. Thus, after the base portion 762 is mounted to the wall, the height of the hung object 14, e.g., the picture, can be adjusted by moving the hook portion 764 longitudinally, i.e., up and done, along the base portion 762. In addition, lateral, i.e., side-to-side, adjustments are also possible.

Figure 20:
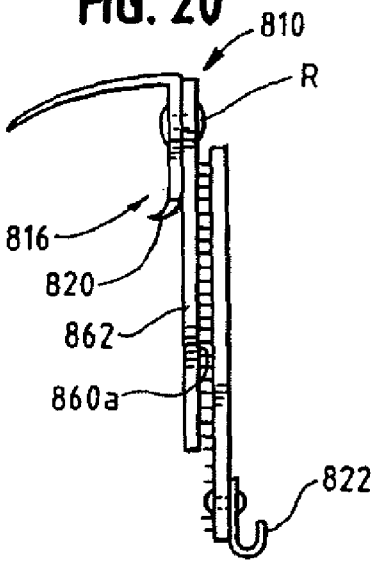
FIG. 20 is a side view of another two part hanger showing the base and hanger portion.
Figure 21:
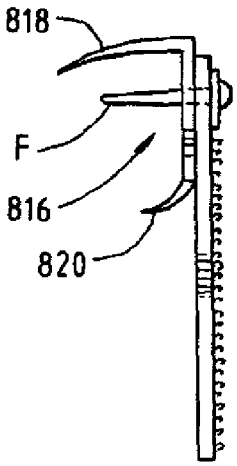
FIG. 21 is an alternate base portion for use with the hanger portions shown in FIGS. 19 and 20.

FIGS. 20 and 21 illustrate another embodiment 810 in which a base portion 862 is affixed to the hanger body 816 by a rivet R or like mechanical fastener, and a portion 860*a* of the hook and loop fastener 860 is affixed to the base portion 862. This embodiment 810 is similar to that of FIGS. 18–19, except that a portion 860*a* of the hook and loop fastener 860 is affixed to a separate base member 862 that is fastened to the hanger body 816. Alternately, as illustrated in FIG. 21, the separate base member 862 can be affixed to the hanger body 816 using a self-limiting fastener F, as discussed previously.

Figure 22:
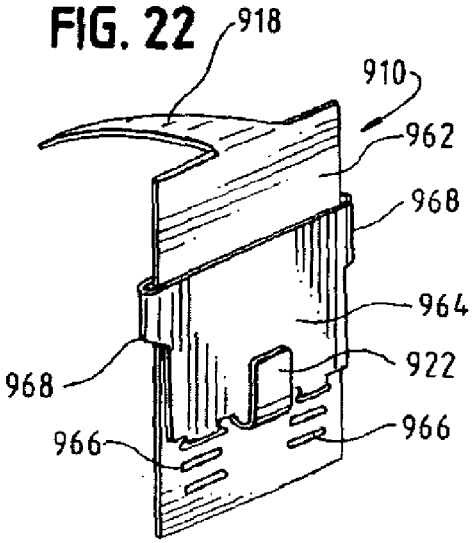
FIG. 22 is a perspective view of still another two part adjustable hanger.
Figure 23:
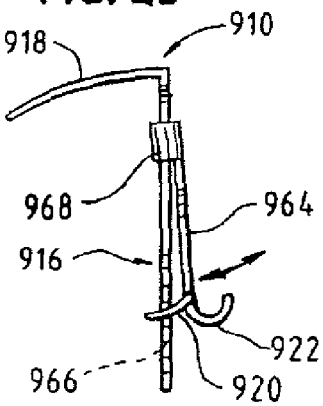
FIG. 23 is a side view of the hanger of FIG. 22.

Another two part adjustable hanger 910 is illustrated in FIGS. 22–23. In this embodiment, a base portion 962 includes the body 916 and the anchoring portion 918. Openings 966 are formed in the base portion 962, below the anchoring portion 918. A hook portion 964 includes a hook 922, a pair of guides 968 extending outwardly from the sides of the hook portion 964, and at least one, and preferably a pair of barbs 920 extending from a bottom end of the hook portion 964. The barbs 920 are configured for insertion through the base portion openings 966 to secure the hanger 910 to the wall. The base portion 962 can positioned on a wall at a desired height. The hook portion 964 can be moved longitudinally, i.e., up and down along the base portion 962 to desired height, and the barbs 920 inserted through the base openings 966 to secure the hook 922 at a desired height. As seen in FIG. 23, the height of the hook portion 964 is readily adjusted by pulling the hook portion 964 (near to the hook 922) from the wall to clear the barbs 920 from the openings 966. The hook portion 964 is then moved up or down along the base 962. Once a desired height is achieved, the barbs 920 are inserted through the openings 966 and urged into the wall. This secures the hanger 910 in place on the wall.

It has been found that each of the embodiments of the hanger 10-910 provides numerous advantages over known hangers. For example, the present hanger 10-910 (when used without a fastener) can be readily installed by simply pushing the hanger into the wall 12 or, if necessary by tapping the hanger 10–910 into the wall 12 with a hammer. Removal of the hanger 10–910 may leave only slight slot and pin holes in the wall 12 that can be readily covered with paint. Even in those instances where a fastener is desired, installation is readily carried out with no more difficulty than known, commercially available hangers. It has also been found that the unique configuration of the present hanger 10–910 provides the ability to support objects weighing over 120 pounds.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A hanger for mounting an associated object to a wall, the hanger comprising:

a body portion having a first surface for bearing against the wall, the body portion defining first and second end portions;

an upper anchoring portion formed at the first end for penetrating the wall and for fastening the hanger to the wall, the upper anchoring portion extending rearwardly from the body portion and formed at an angle 90 degrees or less relative to the body, the anchoring portion having a piercing portion to enable the anchoring portion to be driven into the wall;

at least one barb extending rearwardly from the body portion, the barb being formed intermediate the first end portion and the second end portion; and a hook portion extending generally forwardly from the body portion at the second end portion, the hook being positioned longitudinally spaced from the at least one barb, wherein the body portion includes an opening therein and wherein the opening includes a thread formation therein configured for receiving a threaded fastener, wherein an area surrounding the opening is elevated relative to the body.

2. A hanger for mounting an associated object to a wall, the hanger comprising:

a body portion having a first surface for bearing against the wall, the body portion defining first and second end portions;

an upper anchoring portion formed at the first end for penetrating the wall and for fastening the hanger to the wall, the upper anchoring portion extending rearwardly from the body portion and formed at an 90 degrees or less relative to the body, the anchoring portion having a piercing portion to enable the anchoring portion to be driven into the wall;

at least one barb extending rearwardly from the body portion, the barb being formed intermediate the first end portion and the second end portion; and a hook portion extending generally forwardly from the body portion at the second end portion, the hook being positioned longitudinally spaced from the at least one barb, wherein the body portion includes an opening therein and wherein the opening includes a thread formation therein configured for receiving a threaded fastener, wherein the threaded fastener is configured for receipt in the opening, the threaded fastener having a head portion configured for contacting the body adjacent the opening to limit rotation of the fastener.

3. A hanger for mounting an associated object to a wall, the hanger comprising:

a body portion having a first surface for bearing against the wall, the body portion defining first and second end portions;

an upper anchoring portion formed at the first end for penetrating the wall and for fastening the hanger to the wall, the upper anchoring portion extending rearwardly from the body portion and formed at an angle 90 degrees or less relative to the body, the upper anchoring portion having a piercing portion to enable the upper anchoring portion to be driven into the wall;

at least one barb extending rearwardly from the body portion, the barb being formed intermediate the first end portion and the second end portion; and a hook portion extending generally forwardly from the body portion at the second end portion, the hook being positioned longitudinally spaced from the at least one barb, wherein the hook portion is separable from and adjustable along the body portion, and wherein the hook portion and body portion include mating parts of a hook and loop fastener system.

4. The hanger in accordance with claim 3 wherein the body portion of the hook and loop fastener system is secured to a base element.

5. The hanger in accordance with claim 4 wherein the base element is secured to the body portion by a self-limiting fastener.

6. A hanger for mounting an associated object to a wall, the hanger comprising:

a body portion having a first surface for bearing against the wall, the body portion defining first and second end portions;

an upper anchoring portion formed at the first end for penetrating the wall and for fastening the hanger to the wall, the upper anchoring portion extending rearwardly from the body portion and formed at an angle 90 degrees or less relative to the body, the upper anchoring portion having a piercing portion to enable the upper anchoring portion to be driven into the wall, the upper anchoring portion having a curved profile;

at least one barb extending rearwardly from the body portion, the barb being formed intermediate the first end portion and the second end portion; and a hook portion extending generally forwardly from the body portion at the second end portion, the hook being positioned longitudinally spaced from the at least one barb, the hook portion being separable from and adjustable along the body portion, wherein the body portion includes openings therein and wherein the at least one barb is formed on the hook portion, the barbs being inserted through the openings to secure the hanger to the wall.

7. A hanger for mounting an associated object to a wall, the hanger comprising:

a body portion having a first surface for bearing against the wall, the body portion defining first and second end portions;

an upper anchoring portion formed at the first end for penetrating the wall and for fastening the hanger to the wall, the upper anchoring portion extending rearwardly from the body portion and formed at an angle 90 degrees or less relative to the body, the upper anchoring portion having a piercing portion to unable the upper anchoring portion to be driven into the wall;

at least one barb extending rearwardly from the body portion, the barb being formed intermediate the first end portion and the second end portion; and a hook portion extending generally forwardly from the body portion at the second end portion, the hook being positioned longitudinally spaced from the at least one barb, wherein the body portion includes openings therein and wherein the at least one barb is formed on the hook portion, the barbs being inserted through the openings to secure the hanger to the wall, and wherein the hook portion includes guide elements for slidingly mounting the hook portion to the body portion.

8. A hanger for mounting an object to a wall, the hanger comprising:

a body portion having a first surface for bearing against the wall, the body portion defining first and second end portions;

an anchoring portion formed at the first end for penetrating the wall and for fastening the hanger to the wall, the anchoring portion extending rearwardly from the body portion and formed at an angle less than 90 degrees relative to the body, the anchoring portion having a curved profile;

at least one barb extending rearwardly from the body portion, the barb being formed spaced from the anchoring portion, and being formed at an angle relative to the body greater than 90 degrees; and a hook portion extending generally forwardly from the body portion at the second end portion, distally from the at least one barb, including receiving a fastener formed in the body portion between the anchoring portion and the at least one barb.

9. A hanger for mounting an object to a wall, the hanger comprising:

a body portion having a first surface for bearing against the wall, the body portion defining first and second and portions;

an anchoring portion formed at the first end for penetrating the wall and for fastening the hanger to the wall, the anchoring portion extending rearwardly from the body portion and formed at an angle less than 90 degrees relative to the body, the anchoring portion having a curved profile;

two barbs extending rearwardly from the body portion, the barbs being formed spaced from the anchoring portion, and being formed at an angle relative to the body greater than 90 degrees, the barbs being longitudinally oriented and aligned with one another; and a hook portion extending generally forwardly from the body portion at the second end portion, distally from the barbs, wherein the barbs are formed at different angles relative to the body, both angles being greater than 90 degrees.

10. A hanger for mounting an object to a wall, the hanger comprising:

a body portion having a first surface for bearing against the wall, the body portion defining first and second end portions;

an anchoring portion formed at the first end for penetrating the wall and for fastening the hanger to the wall, the anchoring portion extending rearwardly from the body portion and formed at an angle less than 90 degrees relative to the body, the anchoring portion having a curved profile;

at least one barb extending rearwardly from the body portion, the barb being formed spaced from the anchoring portion, and being formed at an angle relative to the body greater than 90 degrees; and a hook portion extending generally forwardly from the body portion at the second end portion, distally from at least one barb, wherein the hook portion is separable from and adjustable along the body portion.

11. The hanger in accordance with claim 10 wherein the body portion includes at least one opening therein and wherein to at least one barb is formed on the hook portion, the at least one barb being inserted through the body portion at least one opening to secure the hanger to the wall.

12. A hanger for mounting an object to a wall, the hanger comprising:

a body portion having a first surface for bearing against the wall, the body portion defining first and second end portions;

an anchoring portion formed at the first end for penetrating the wall and for fastening the hanger to the wall, the anchoring portion extending rearwardly from the body portion and formed at an angle less than 90 degrees relative to the body;

at least one barb extending rearwardly from the body portion, the barb being formed spaced from the anchoring portion, and being formed at an angle relative to the body greater than 90 degrees; and a hook portion extending generally forwardly from the body portion at the second end portion, distally from the at least one barb, wherein the hook portion is separable from and adjustable along the body portion and wherein the hook portion and body portion include mating parts of a hook and loop fastener system.

13. The hanger in accordance with claim 12 wherein to body portion of the hook and loop fastener system is secured to a base element.

14. The hanger in accordance with claim 13 wherein the base element is secured to the body portion by a self-limiting fastener.

15. A hanger for mounting an object to a wall, the hanger comprising:

a body portion having a first surface for bearing against the wall, the body portion defining first and second end portions;

an anchoring portion formed at the first end for penetrating the wall and for fastening the hanger to the wall, the anchoring portion extending rearwardly from the body portion and formed at an angle less than 90 degrees relative to the body;

at least one barb extending rearwardly from the body portion, the barb being formed spaced from the anchoring portion, and being formed at an angle relative to the body greater than 90 degrees; and a hook portion extending generally forwardly from the body portion at the second end portion, distally from the at least one barb, wherein the hook portion is separable from and adjustable along the body portion, the body portion including at least one opening therein and wherein the at least one barb is formed on the hook portion, the at least one barb being inserted through the body portion at least one opening to secure the hanger to the wall, wherein the hook portion includes guide elements for slidingly mounting the hook portion to the body portion.

* * * * *

UNITED STATES PATENT AND TRADEMARK OFFICE

CERTIFICATE OF CORRECTION

PATENT NO. : 6,830,228 B2
DATED : December 14, 2004
INVENTOR(S) : Richard J. Ernste It is certified that error appears in the above-identified patent and that said Letters Patent is hereby corrected as shown below:

Replacement of informal drawings in file with five (5) sheets of formal drawings submitted herewith.

Signed and Sealed this

Fifth Day of April, 2005

JON W. DUDAS
*Director of the United States Patent and Trademark Office*